United States Patent [19]

Quintarelli

[11] Patent Number: 4,562,605

[45] Date of Patent: Jan. 7, 1986

[54] APPARATUS APPLICABLE FOR THE INTRODUCTION OF CONTROLLED AND MEASURED QUANTITIES OF A LIQUID, INTO ANOTHER BODY OF LIQUID

[76] Inventor: Claudio Quintarelli, Viale Algeria, 93, 00144 Roma, Italy

[21] Appl. No.: 599,953

[22] Filed: Apr. 13, 1984

[51] Int. Cl.[4] ..... D06F 39/02

[52] U.S. Cl. ..... 8/158; 68/17 R; 68/207; 137/565; 239/214

[58] Field of Search ..... 8/158; 68/207, 17 R; 137/565; 222/1, 651, 652; 239/214, 223

[56] References Cited

U.S. PATENT DOCUMENTS

| | | | |
|---|---|---|---|
| Re. 30,097 | 9/1979 | Gillespie | 222/651 X |
| 2,873,600 | 2/1959 | Demaret | 68/207 X |
| 3,266,781 | 8/1966 | Eppenberger | 366/169 X |
| 4,444,510 | 4/1984 | Janssen | 366/169 |

FOREIGN PATENT DOCUMENTS

| | | | |
|---|---|---|---|
| 81647 | 3/1894 | Fed. Rep. of Germany | 366/169 |
| 449273 | 8/1925 | Fed. Rep. of Germany | 366/169 |
| 251797 | 2/1974 | U.S.S.R. | 239/223 |

*Primary Examiner*—Philip R. Coe
*Assistant Examiner*—Frankie L. Stinson
*Attorney, Agent, or Firm*—Laurence R. Brown

[57] ABSTRACT

Herein is described an apparatus applicable to washing machines for the introduction of controlled and measured quantities of a liquid into another body of liquid. The apparatus consists of a revolving mechanism in communication with the fluid to be injected and a motor (12) for the rotation of the revolving mechanism. The revolving mechanism has on its perimeter one or more openings (2) each with a deflector (3) placed on the side of the opening (2) in the direction of the rotation of the revolving mechanism. Its rotation and the consequent deformation of the streamline flow (5) of the liquid in which the revolving mechanism rotates establishes a suction condition at the openings of the revolving mechanism which favors the injection of the liquid from the revolving mechanism into the liquid of the body.

4 Claims, 3 Drawing Figures

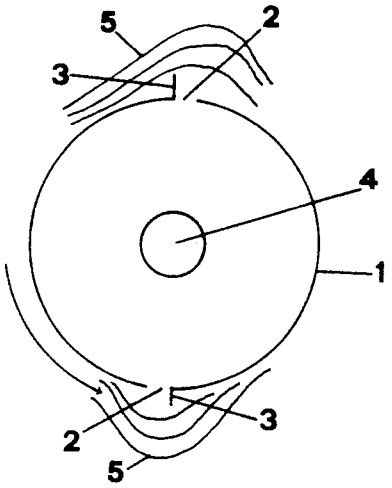
FIG 1
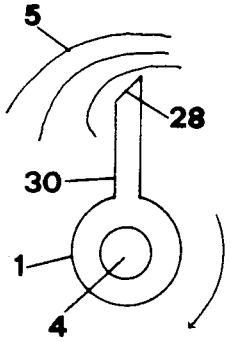
FIG 3
FIG 2
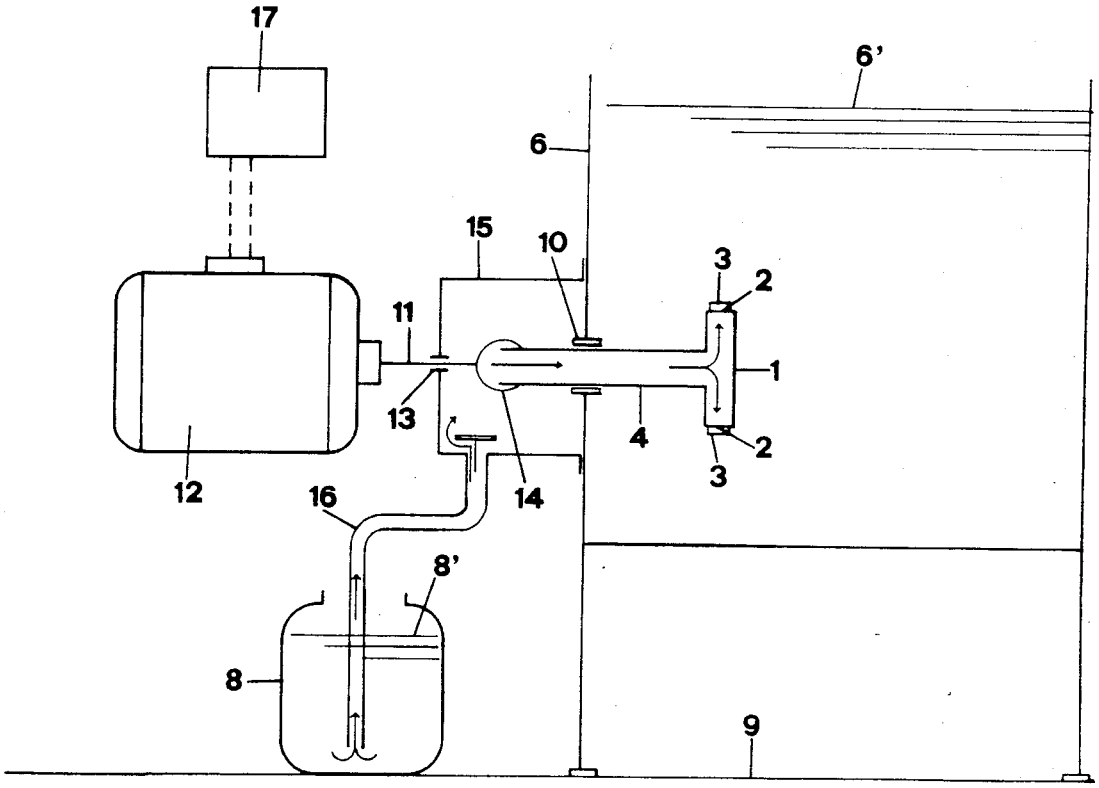

APPARATUS APPLICABLE FOR THE INTRODUCTION OF CONTROLLED AND MEASURED QUANTITIES OF A LIQUID, INTO ANOTHER BODY OF LIQUID

BACKGROUND ART

It is known that one of the major problems encountered in practical application, particularly for use in washing machines, is to introduce measured quantities of a liquid into another body of liquid. In order to add a liquid chemical solution to another body of liquid, the U.S. Pat. Nos. 3,095,121 and 4,306,581 employ suction means connected to the circulation hose of the liquid body which is to receive the said chemical product. The U.S. Pat. No. 4,218,264 shows a dishwasher in which the suction created by the pump controlling the water circulation during the wash and rinse cycle, draws out from dispensers the liquid detergent to be mixed with the water.

These examples of known technology all have the disadvantage of needing water, or another liquid in motion to draw out from the dispenser the necessary quantities of the liquid additive or detergent. This causes a complexity in the necessary equipment and constitutes a difficulty in controlling the exact dosage of the liquid substance to be added.

To eliminate the drawbacks inherent with pumps that are not automatic, peristaltic pumps have also been used; nevertheless these are associated with high installation and maintenance costs.

In any event, the introduction of the additive liquid by means of circulation pumps which are already in the washing machines, as aforesaid, has the drawback of not permitting an exact and efficient dosage of the additive; while other pumps are not automatic or are relatively complex to operate and are also expensive.

These are great drawbacks when we consider that washing machines, whether they be industrial or domestic, should be highly reliable and cost-effective.

DISCLOSURE OF THE INVENTION

The invention herein described is an apparatus applicable to washing machines for the introduction of controlled and measured quantities of one liquid into another body of liquid.

The basic concept of the invention is the introduction or injection of the fluid (hereafter called additive) by means which are independent from the machine to which the apparatus is to be attached. The means function in the tube of the washing machine (presented here as an embodiment) when there is in the liquid body for receiving the injection a predetermined quantity of liquid necessary for the proper function of the machine. While we shall describe as a washing machine embodiment the machine to which the apparatus is attached, nevertheless, the same apparatus can be attached to other types of machines, for example, to an ice-maker.

According to this invention, the additive is extracted from its dispenser by means of a rotating mechanism immersed in the liquid body of the washer, which is caused to rotate by its own motor.

The rotating mechanism, typically a solid of revolution, is essentially made up of a hollow body having one or more surface openings or windows, and at the side of these openings, in the direction of motion, are located deflectors extending beyond these openings. It is to be noted that as it is well known in aerodynamics, a fluid current which collides in its relative motion with a body, bisects itself so as to envelop the entire surface of the body, and if the body has a protrusion, this cannot be enveloped by the fluid. Consequently in the areas where the streamline flow is disturbed by the deflectors, a zone of lower pressure is created, (corresponding to the position of the openings) resulting in a suction action.

According to the invention the revolving mechanism communicates with a dispenser containing the liquid additive, and at the same time is made to rotate by an appropriate standard motor, independent of other motors present in the washing machine. The revolving mechanism will suck up a predetermined controlled quantity of additive as a function of the speed of rotation imparted to it or its actual rotation, and as a function of the density of the liquid in which it is rotating.

The apparatus is naturally provided of other accessories, among which are a regulator which optimizes its operation.

BRIEF DESCRIPTION OF THE DRAWINGS

The invention will be better understood from the more detailed description of one of its embodiments which follows. The description refers to the attached diagrams in which:

FIG. 1 shows the working plan of the revolving mechanism relevant to this invention;

FIG. 2 shows the working plan of apparatus for the addition of a fluid into another fluid body;

FIG. 3 shows a further embodiment of the rotating body.

THE PREFERRED EMBODIMENT

Referring to the mentioned drawings, and specifically to FIG. 1, a hollow body 1 is provided at its perimeter by one or more openings 2 and has externally protruding deflectors 3. The hollow body 1 can be rotated about its axis 4 and is in communication with a fluid dispenser (not shown in FIG. 1), for example by means of a hollow axis 4. If the rotating hollow body 1 is immersed in a container full of liquid which completely envelopes it and a rotation is imparted to it, for example in the direction indicated by the arrow, the streamlines 5 of the liquid in the container will assume a shape as shown.

That is, in the vicinity of the openings 2, the shape of the streamlines 5 is altered creating a pressure depression which is translated into a suction of the fluid contained inside the hollow body 1 and thus in the dispenser of the liquid additive. The fluid sucked through the depression created over the opening 2 by the deformation of the streamlines, causes the injections of the fluid into the rotating mechanism 1 into contact with the liquid body of the container.

As explained, by regulation of the number of turns of the rotating mechanism 1 and/or its activation time, it is possible to control the quantity of fluid injected into the liquid mass.

Referring now to FIG. 2 note that the apparatus according to the invention, which utilizes the revolving mechanism indicated in FIG. 1, consists essentially of a revolving mechanism 1, of a hollow shaft 4, of a motor 12 activating the revolving mechanism 1, and a dispenser 8 for the additive. The maximum levels achievable by the liquid in the tub 6 and by the additive in the dispenser 8 are indicated by 6' and 8' respectively. The hollow shaft 4 extends into a containing chamber 15 in which, due to the turning action of the spinner 1, accumulates the additive sucked up from the dispenser 8 through a tube 16. Gaskets 10 and 13 seal the containing chamber 15 from the liquid in the tub 6 and from the atmosphere at the motor 12; that is, they prevent leakage around the hollow shaft 4 and around the motor shaft 11. An appropriate coupling 14 joins the hollow shaft 4 with the motor shaft 11.

The apparatus is completed by a regulator 17 which controls the speed and/or the rotation time of the motor 12 and therefore, of the rotating body 1.

The apparatus of this invention functions as follows. Assuming a starting level 9 (shown in FIG. 2) the water in the tub 6 will reach level 6' above the level 8' of the additive in the dispenser 8. Because of the rotation imparted by the motor 12, through the motor shaft 11, the spinner 1 rotates, and as previously illustrated in FIG. 1, the streamlines in the liquid in the tub 6 will be deformed (as shown in 5 of FIG. 1) by the deflectors 3, causing a pressure depression near the openings 2, and, therefore a suction of the additive into the containing chamber 15. The additive will follow the path indicated by the arrows in FIG. 2 and exiting the rotating body 1, will mix with the liquid body container in the tub 6.

The regulator 17 will act upon the motor to start and stop it, or even eventually to regulate the number of turns, as a function of the demand or the necessity to send additive from the dispenser 8 into the tub 6. The regulator 17 will function essentially as a "timer" of a type well known in engineering, which if necessary could receive a command even from a sensor which senses the chemical characteristics of the liquid in the tub 6.

Due to the rotation of the rotating body 1, as explained, a lower pressure results at the openings 2 and, therefore, a suction of the additive takes place. This lower pressure is created every time the body 1 is rotating, and it is not necessary that the containing chamber 15 and the tubing 16 are filled up (by the additive) before activating the rotating body; since the action of the rotating body itself will cause the additive to flow up into the chamber 15. Therefore, no particular preparations are necessary for the functioning of the apparatus.

It was indicated that the rotating body 1 could have any appropriate shape and has essentially the shape of a hollow solid body of revolution.

As indicated by FIG. 3 schematically, the rotating body can assume the shape of a tube or an extension 30 from the hollow shaft 4, having its extremity 28 cut at an angle, in the opposite direction of rotation, so as to present the longer side forward, toward the direction of motion. The streamlines 5, as shown in FIG. 1, are deformed, and cause near the opening formed by the angle cut 28, a pressure depression which will function exactly as previously explained.

In other words, the forward part of the extremity of the tube 30 will function exactly like the deflector 3 indicated previously. Analogously, one can foresee for the rotating body other possible shapes, more or less ending at an angle; but one should always keep in mind that the longer part of the edge has to face in the direction of rotation.

The advantages of this invention are obvious. In particular, note that with this apparatus it is possible to dose with precision any additive without necessitating modifications on the machine on which the apparatus is mounted.

Additionally, the low cost of the apparatus and the fact that the apparatus is independent from the circuitry necessary for the operation of the washing machine, mean that any malfunction can be fixed immediately and with a minimum cost.

Actually, when there is no more additive, upon an optical and/or acoustic signal given by the regulator 17 or another like system one could immediately intervene to substitute the dispenser 8 or to replenish the dispenser 8 with additive. The lack of water in the tub 6 logically stops the phenomenon of suction of the additive, since the absence of deformed streamlines due to the spinner 1, precludes the formation of a depression and therefore the suction action and additive addition ceases automatically and independently of any other action.

As previously explained, naturally the regulation of the dosage of the additive will be as a function of the speed of the spinner, and by the intervention of the regulator 17 which will act to control the speed, the time or rotation of the motor 12, and other parameters affecting the dosage.

The apparatus is particularly applicable to washing machines, for the introduction of controlled and measured quantities of a liquid detergent into the wash water liquid, but will also find useful applications in those occasions when a fluid has to be added to another fluid whether or not this other fluid is in motion or is in a gaseous or liquid state. The invention will be amenable to those improvements brought about by technology and practical applications, without departing from the concepts of the invention, as will be presented in the claims that follow.

I claim:

1. Apparatus for introduction of metered quantities of an additive liquid to be injected into another body of liquid, comprising in combination, means for injecting the additive liquid into the body of liquid by rotating a revolvable hollow mechanism in a single direction of rotation, said mechanism having at least one opening and a deflector extension protruding radially beyond the opening adjacent only that side of the opening in the single direction of rotation shaped and spaced from the opening for deflecting the liquid of the body to create a suction at the opening sufficient to draw the additive liquid from a store of the additive liquid through the hollow mechanism, means positioning the revolvable mechanism in said body of liquid for rotation therein, a store of liquid to be metered into said body of liquid in communication with said hollow mechanism to permit flow into the liquid body responsive to said suction, and regulating means for controlling rotation of said mechanism to introduce a predetermined measure of liquid from said store of liquid through said mechanism into said liquid body.

2. Apparatus as defined in claim 1 wherein the injected liquid is metered into the body of liquid by means adjusting the level of the body of liquid in which the mechanism revolves thereby to inject the store of liquid only when the revolving mechanism becomes immersed into the body of liquid.

3. The method of sucking an exterior additive washing liquid into a liquid body of a washing machine from a rotating hollow body in the washing machine through a rotatable opening therein comprising the steps of rotating the body and opening in a single direction for sucking the additive liquid into the liquid body, providing deflection means radially extending from the rotating body adjacent to and on the side of the opening in the direction of the rotation with such shape to produce upon rotation in the liquid body lower fluid pressure in the liquid body at the opening to provide enough suction to suck the additive liquid from an exterior store into the liquid body, and coupling an exterior source of additive liquid to the opening for suction into the liquid body as a result of the rotation of the body.

4. The method defined in claim 3 including the step of washing articles in the body of liquid and controlling a washing chemical by the injection of the exterior liquid into the liquid body within a container only when the level of the liquid body immerses the hollow body to thereby produce said suction.

* * * * *